United States Patent [19]

George

[11] Patent Number: 5,002,043

[45] Date of Patent: Mar. 26, 1991

[54] INVERSION APPARATUS

[76] Inventor: Achilles N. George, 7688 S. Strawtown Pike, Jonesboro, Ind. 46938

[21] Appl. No.: 91,648

[22] Filed: Aug. 31, 1987

Related U.S. Application Data

[63] Continuation-in-part of Ser. No. 775,143, Sep. 12, 1985, Pat. No. 4,690,133.

[51] Int. Cl.[5] ..... A61H 1/02

[52] U.S. Cl. ..... 128/25 R; 272/117; 272/134; 272/145

[58] Field of Search ..... 128/25 R; 272/93, 117, 272/134, 144, 145, 900

[56] References Cited

U.S. PATENT DOCUMENTS

| | | | |
|---|---|---|---|
| 2,159,654 | 5/1939 | Catlin | 272/144 |
| 2,467,236 | 4/1949 | Sefton | 272/144 |
| 2,992,009 | 7/1961 | Dimitriadis | 272/93 |
| 2,999,688 | 9/1961 | Gabrielson | 272/144 |
| 3,000,632 | 9/1961 | Fuchs | 272/134 |
| 3,286,708 | 11/1966 | Gartner | 272/145 |
| 4,407,496 | 10/1983 | Johnson | 272/117 |
| 4,512,572 | 4/1985 | Hamm | 272/145 |
| 4,546,967 | 10/1985 | Kecala | 272/93 |
| 4,634,127 | 1/1987 | Rockwell | 272/144 |
| 4,696,469 | 9/1987 | Elder | 272/134 |

FOREIGN PATENT DOCUMENTS

| | | | |
|---|---|---|---|
| 8401303 | 4/1984 | World Int. Prop. O. | 272/117 |

OTHER PUBLICATIONS

Warren, Backswing, International Health Fair, Washington, D.C., 11/17/83; Warren Wallring, Baltimore, Md.

Universal; Weight Equipment, 1985 Catalog; pp. 11–13, Nos. 3098, 3095 and 9746.

*Primary Examiner*—Edgar S. Burr
*Assistant Examiner*—Huong Q. Pham
*Attorney, Agent, or Firm*—Harness, Dickey & Pierce

[57] ABSTRACT

Apparatus for enabling individuals to suspend themselves in an inverted position from suitably positioned spaced parallel supports engaging the individual's legs at the back of the knee and instep so as to subject the body to a natural gravitational traction thereby relieving the spinal column from compressive forces exerted thereon is disclosed. The apparatus includes arrangements for adjusting both the distance between the instep and back of the knee supports as well as the degree of knee bend required when the user is in an inverted position. In one embodiment, the apparatus is supported in an upright position and grab bars are provided for aiding the user in positioning himself therein. In another embodiment, the apparatus is movable between a horizontal position wherein the user may easily position himself on the apparatus and a vertical position wherein the user is positioned in the desired inverted position. Another embodiment is also illustrated which is particularly well suited for use by children.

22 Claims, 9 Drawing Sheets

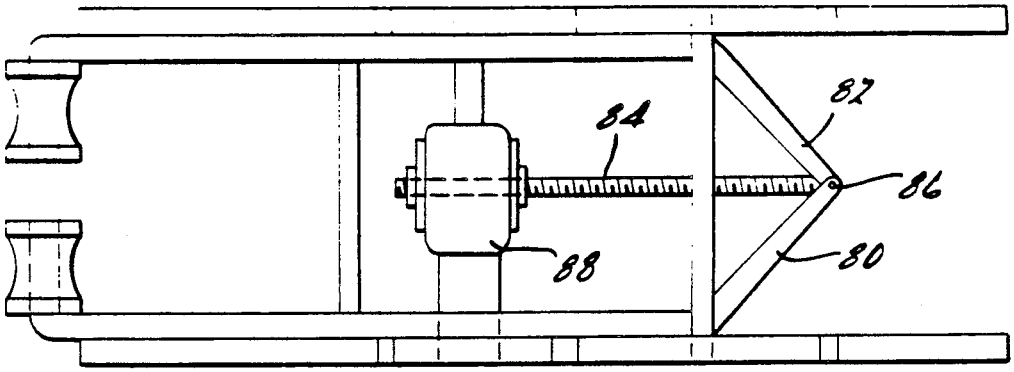
FIG. 7.
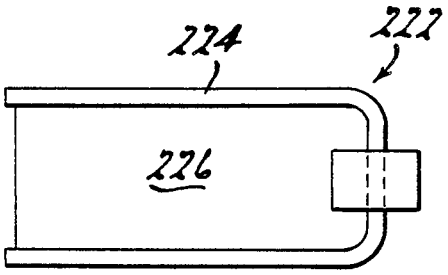
FIG. 9.
FIG. 10.
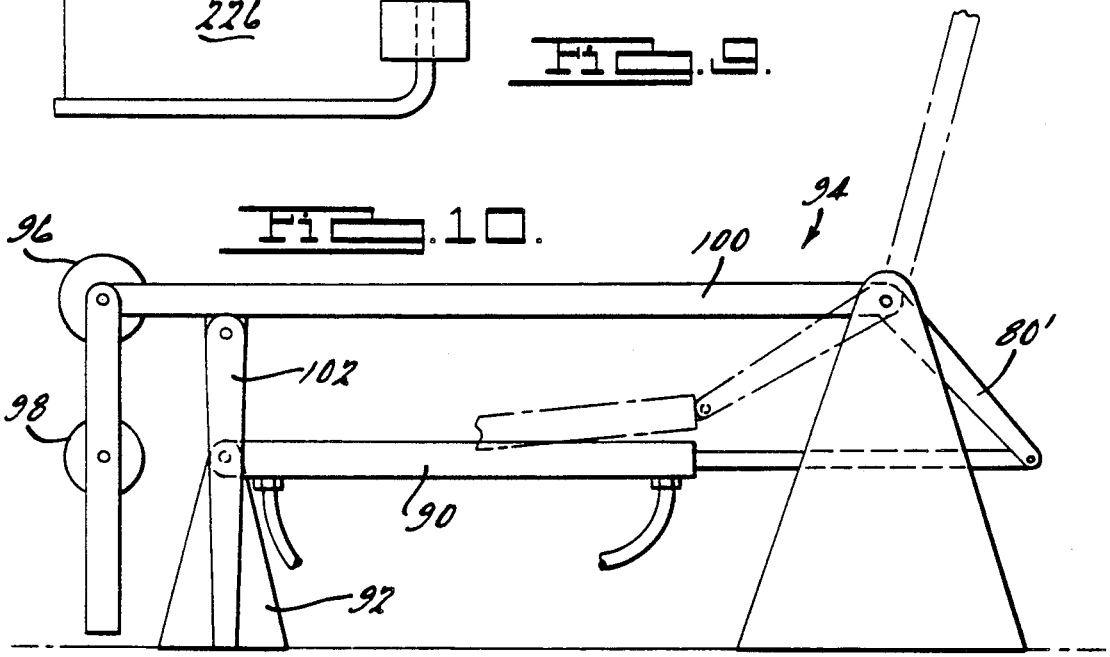
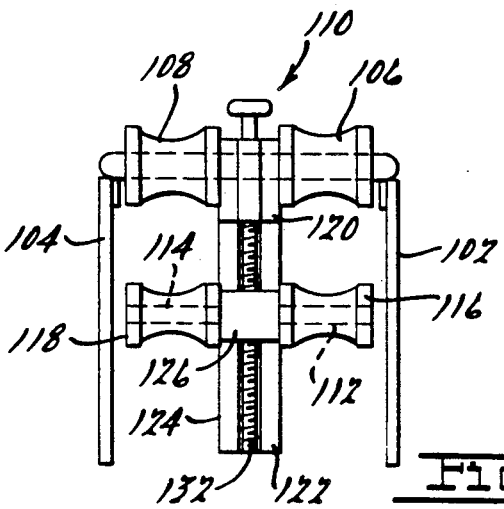
FIG. 8.
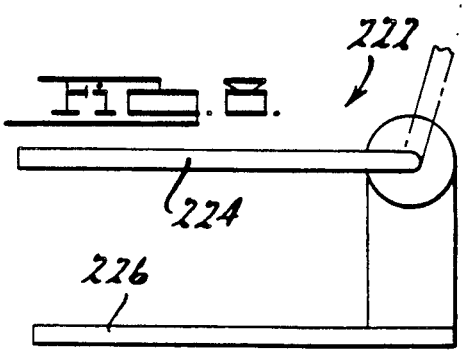
FIG. 11.

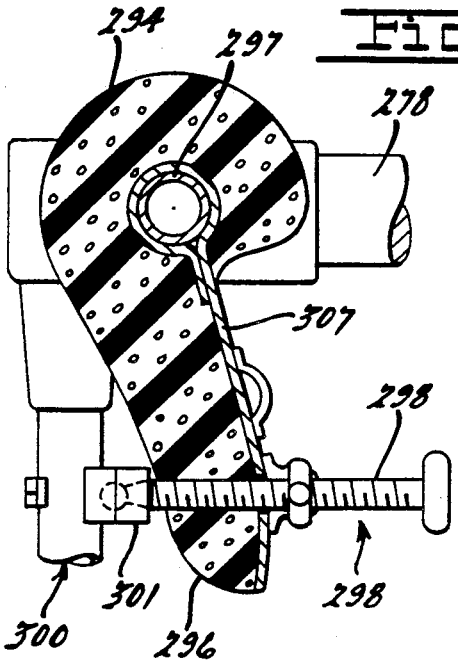
FIG. 26.
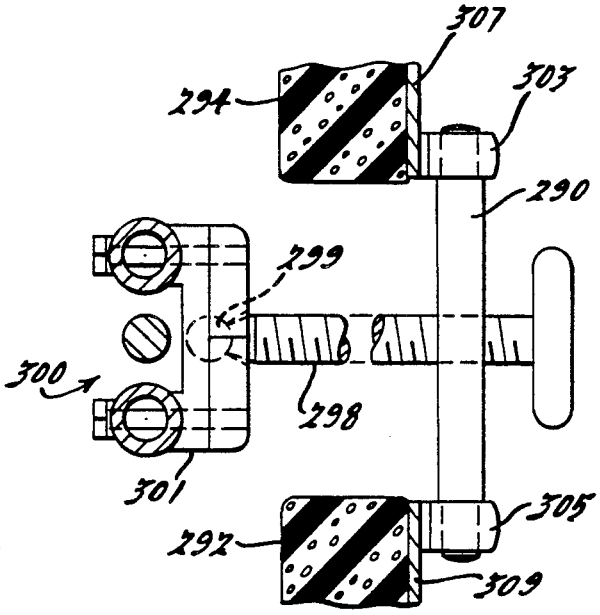
FIG. 27.
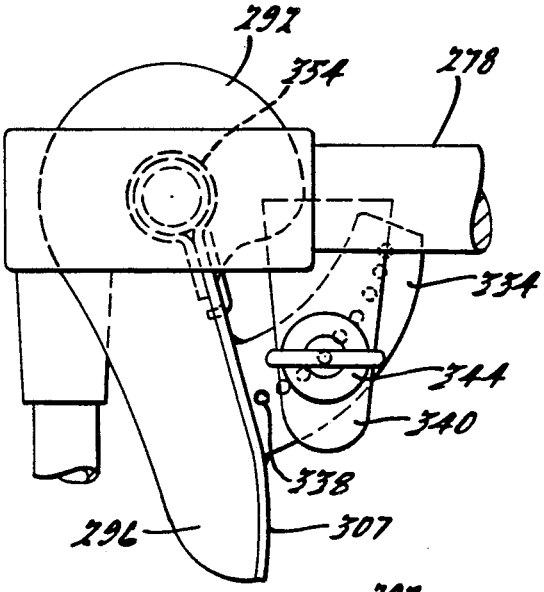
FIG. 31.
FIG. 32.
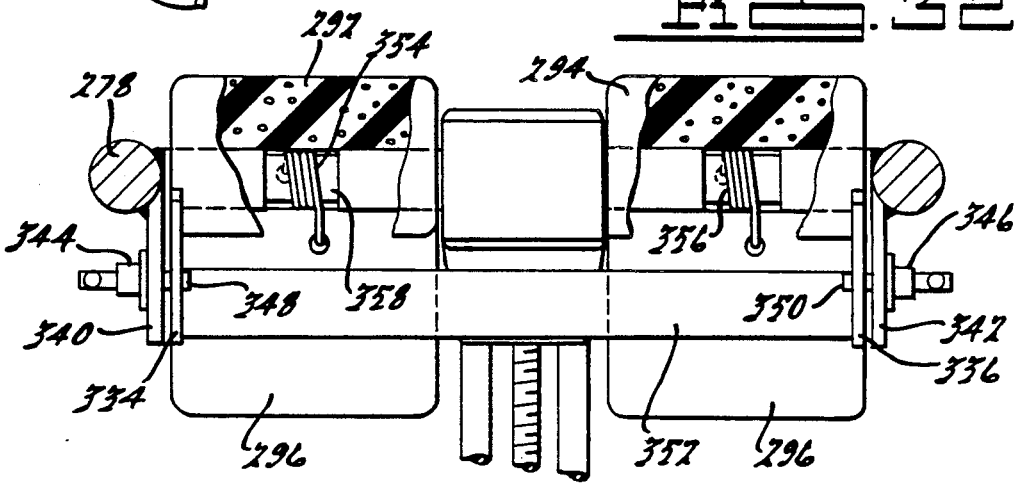

INVERSION APPARATUS

CROSS REFERENCE TO RELATED APPLICATION

This application is a continuation-in-part of application Ser. No. 775,143, filed Sept. 12, 1985, entitled "Inversion Apparatus", now U.S. Pat. No. 4,690,133.

BACKGROUND AND SUMMARY OF THE INVENTION

The present invention relates generally to therapeutic devices and more particularly to such devices which are designed to facilitate inversion and suspension of a human from the lower legs so as to provide a natural gravitational traction on the upper body portions.

Various types of apparatus have long been utilized by individuals to suspend themselves in an inverted position. Such apparatus has taken a wide variety of forms such as for example ranging from a trapeze commonly provided on children's swing sets to specialized footwear which is designed to be hooked over an elevated bar or rod. Other types of apparatus have been designed to be secured within a doorway or the like and provide means for suspending an individual from the lower portions of the legs such as for example the apparatus illustrated in U.S. Pat. Nos. 4,458,894; 4,461,287 or 3,593,708. While such apparatus may be well suited for supporting an individual in an inverted position, it is relatively difficult for an individual to position himself within the apparatus as well as to extracate himself therefrom. The principal reason for this difficulty lies in the fact that this prior art apparatus is designed to be secured in the position from which the individual will be suspended thus requiring the user thereof to elevate himself sufficiently so as to be able to position his lower extremities in appropriate relationship with the apparatus. While this may not be a problem for a strong, healthy individual, such apparatus is difficult if not impossible for use by less able bodied individuals. Another problem associated with the apparatus lies in the fact that to the extent such apparatus may incorporate leg engaging supports, they are positioned in a fixed relationship which may not correspond to the ideal location for a given size individual and thus render the apparatus uncomfortable for use by such individual.

The present invention, however, provides inversion apparatus which overcomes these problems and disadvantages of prior art apparatus in that it incorporates means for easily and readily adjusting the relative distances between body engaging portions thereof as well as providing adjustment for the relative angulation thereof. The inversion apparatus of the present invention is of the type which employs a pair of spaced support members which are designed to be engaged by the back of the knee of an individual and the individual's instep in such a manner as to thereby provide support for suspending the upper portions of the body in an inverted position. The apparatus incorporates means whereby the relative positioning of these support members may be easily modified so as to readily accommodate different size individuals as well as to insure that the support members engage the user of the apparatus in the most comfortable position possible. Additionally, the apparatus incorporates means whereby the angulation between the upper and lower portions of the leg may be set to any desired degree thus further contributing to the comfortable usage of the apparatus.

One embodiment of the present invention is designed to be fixedly positioned in a vertical orientation and thus require a user thereof to physically elevate and position himself within the apparatus. Other embodiments of the apparatus of the present invention are designed to enable the individual to position himself therein while the apparatus is in a horizontal position after which a third person or the individual may easily elevate the apparatus into a vertical position with the user thereof moving into suspended relationship with respect thereto. This arrangement greatly facilitates use of the apparatus not only by strong, healthy individuals but also enables those less able bodied individuals to obtain the benefits offered thereby without requiring a great amount of assistance from third parties. Thus, as will become more apparent from the following description, the present invention is well suited for use by a wide variety of individuals having a great range of strength and agility.

Additional advantages and features of the present invention will become apparent from the subsequent description and the appended claims taken in conjunction with the accompanying drawings.

BRIEF DESCRIPTION OF THE DRAWINGS

FIG. 7 is a plan view of the drive arrangement illustrated and incorporated in the embodiment of FIG. 6;

FIG. 8 is a side elevational view of yet another embodiment of the present invention;

FIG. 9 is a plan view of the embodiment illustrated in FIG. 8;

FIG. 10 is also another view similar to that of FIGS. 3 and 6 but illustrating yet another embodiment of the inversion apparatus of the present invention;

FIG. 11 is a front elevational view of the apparatus illustrated in FIG. 10 illustrating the adjustment arrangement for positioning of the instep support members;

FIG. 26 is an enlarged fragmentary side view of a portion of the inversion apparatus illustrated in FIG. 23 showing an arrangement for adjusting the calf engaging pads thereof in accordance with the present invention;

FIG. 27 is a fragmentary plan view of the adjustment arrangement illustrated in FIG. 26;

FIG. 31 is a fragmentary side view similar to that of FIG. 26 but showing another alternative arrangement for adjusting the calf engaging pads in accordance with the present invention; and FIG. 32 is a fragmentary end view similar to that of FIG. 29 but showing the adjustment arrangement of FIG. 31.

DESCRIPTION OF THE PREFERRED EMBODIMENTS

Figure 1:
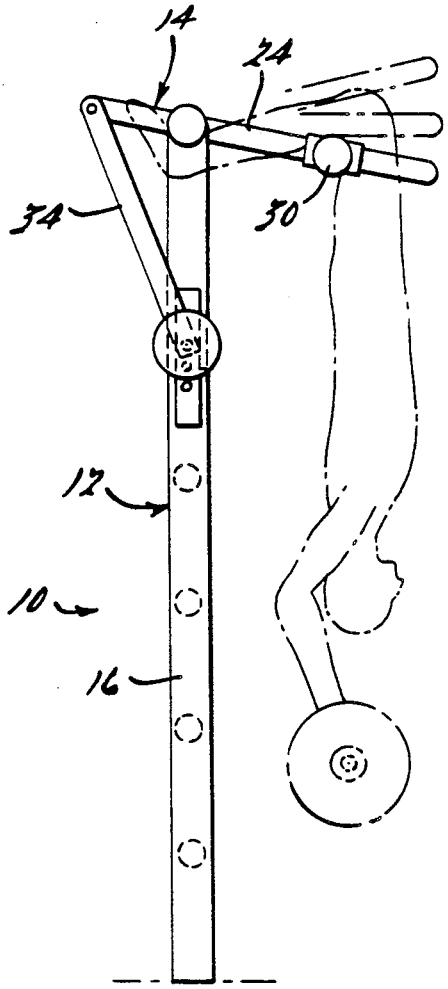
FIG. 1 is a side elevational view of an inversion apparatus in accordance with the present invention with an individual illustrated in suspended relationship thereto.
Figure 2:
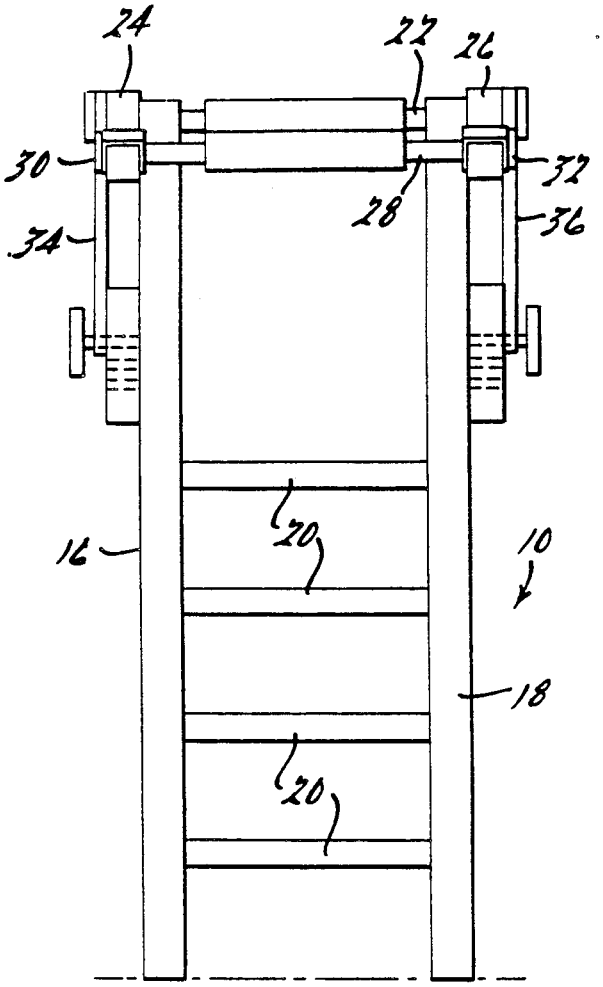
FIG. 2 is a front elevational view of the apparatus illustrated in FIG. 1.

Referring now to the drawings and in particular to FIGS. 1 and 2, there is illustrated a relatively simple, straightforward embodiment of the inversion apparatus in accordance with the present invention indicated generally at reference number 10. Inversion apparatus 10 comprises a generally vertically extending ladder assembly 12 having secured to the upper end thereof an inversion support assembly 14.

The vertically extending ladder assembly 12 comprises a pair of generally parallel extending spaced frame members 16, 18 having a plurality of generally horizontally extending step members 20 extending therebetween and secured at their opposite ends to the respective frame members 16, 18. Any suitable means may be provided for securely supporting the ladder assembly in this vertically oriented position.

The inversion support assembly 14 comprises an instep support member 22 extending between and projecting laterally outwardly from opposite sides of respective ladder frame members 16, 18. A pair of elongated bar members 24, 26 are pivotably supported by the outer ends of the instep support member 22 intermediate the ends thereof. A knee support bar 28 is provided extending between the elongated bar members 24, 26 and adjustably supported thereby in spaced relationship to the instep support member 22. Suitably threaded set screw type clamp means 30, 32 are provided at opposite ends of knee support member 28 so as to enable it to be fixed along bar members 24, 26 in any desired relative spaced relationship to instep support 22.

In order to adjust the relative angulation between instep and knee support members 22, 28, a pair of elongated bracket members 34, 36 are provided each having one end pivotably connected to one of the respective elongated bar members 24, 26 and the other end adapted to be secured to suitable means provided on respective of the vertically extending ladder support members 16, 18. As shown therein, bracket members 34, 36 may be suitably positioned at any one of a plurality of locations thereby enabling the elongated bar members 24, 26 and hence the knee support member 28 to be positioned at any desired relative angulation with respect to the vertically extending ladder members 16, 18.

It should be noted that the elongated bar members 24, 26 pivotably supported at the top of the ladder support members 16, 18 will preferably be of a length substantially greater than the length needed to allow adjustment of the knee support member 28 so as to thus provide a pair of laterally spaced hand grips which may be utilized by the user of the apparatus to facilitate his positioning on the apparatus. Also, both instep and knee support members 22, 28 will preferably be provided with suitably cushioned pads.

In order for an individual to utilize inversion apparatus 10, it is first necessary for him to suitably position the knee support member 28 in the approximate desired location with respect to the instep support member 22. Thereafter, the relative estimated angulation will be selected and the elongated bracket members 34, 36 secured so as to position the knee support member 28 in a suitable location. Next, the individual will ascent the ladder structure via the horizontally extending step members 20 provided thereon and position himself with his insteps engaging the bottom surface of the instep support member 22 and the back of his knees engaging the upper surface of the knee support member 28 generally as illustrated in phantom in FIG. 1. Grasping the outwardly projecting ends of the elongated bar members 24, 26, the individual may then lower himself into an inverted suspended position with respect to the apparatus. The procedure may easily be reversed in order for the user thereof to extracate himself from the apparatus upon completion of his desired time in suspension.

While the above described inversion apparatus of the present invention is extremely well suited for use by healthy, strong able bodied individuals having the agility and dexterity to position and extracate themselves from the apparatus, there are many applications wherein an individual not possessing such sufficient agility may desire to obtain the benefits afforded by such inversion apparatus. Accordingly, the present invention contemplates an embodiment of the apparatus wherein a user may easily position himself within the apparatus in a reclining position after which the apparatus may be elevated either by the user or by an assistant into a position in which the individual is supported in a suspended inverted relationship. One such embodiment is illustrated and will be described in greater detail with reference to FIGS. 3 and 4.

Inversion apparatus 38 comprises a generally planar support platform 40 having a suitable supporting base 42 pivotably secured to one end thereof so as to support it in spaced relationship to the floor or the like. A suitable knee support bar 44 extends transversely across the platform 40 at the opposite end thereof and may be provided with a suitable pad or cushion 46. A pair of downwardly extending leg members 48, 50 are also pivotably secured at this end of the platform and operate to aid in supporting the platform when the platform is in a horizontal position as shown. An instep support member 52 is also provided extending laterally between the leg members 48, 50 and is adjustably secured thereto whereby the distance between the instep support member 52 and the knee support bar 44 may be suitably adjusted so as to accommodate a desired individual. In order to adjust the relative angulation or degree of leg bend required of an individual using this apparatus, each of the leg members 48, 50 is provided with a diagonally extending strut 54 having one end pivotably secured to the platform and the other end pivotably secured to the lower end of the respective leg structure. The struts 54 each comprises a pair of telescopically interfitted members 56, 58 which may be locked in any suitable position by means of hand wheel 60 thereby enabling the legs 48, 50 to be positioned in any desired angulation with respect to the platform itself. Additionally, these struts 54 serve to maintain the legs 48, 50 in the locked position once it has been adjusted so as to thereby enable the instep support member 52 to provide the necessary cantilevered support engagement to a user's legs.

One or preferably two suitable hydraulic or pneumatic actuated cylinders 62, 64 are also provided having one end pivotably secured to a base portion 66 and the other end suitably pivotably secured to the platform 40. Inlets/outlets 68, 70 are provided to which suitable supply lines may be connected so as to conduct a suitable pressurized fluid to opposite ends of each of the actuating cylinders 62. As best seen with reference to FIG. 3, pressure actuated cylinders 62, 64 operate to elevate the platform from a generally horizontal position to a generally vertical position such as that shown in phantom therein whereby an individual having initially positioned himself in a reclining position on the upper surface of the platform 40 is moved into a suspended relationship being held there securely by engagement of the knee and instep supporting members 44 and 52 with the respective portions of his legs. Preferably, suitable control means will also be provided on the platform 40 whereby the individual may easily control operation of cylinders 62, 64 and hence operate the platform 40 into the elevated position without assistance from third parties.

Figure 3:
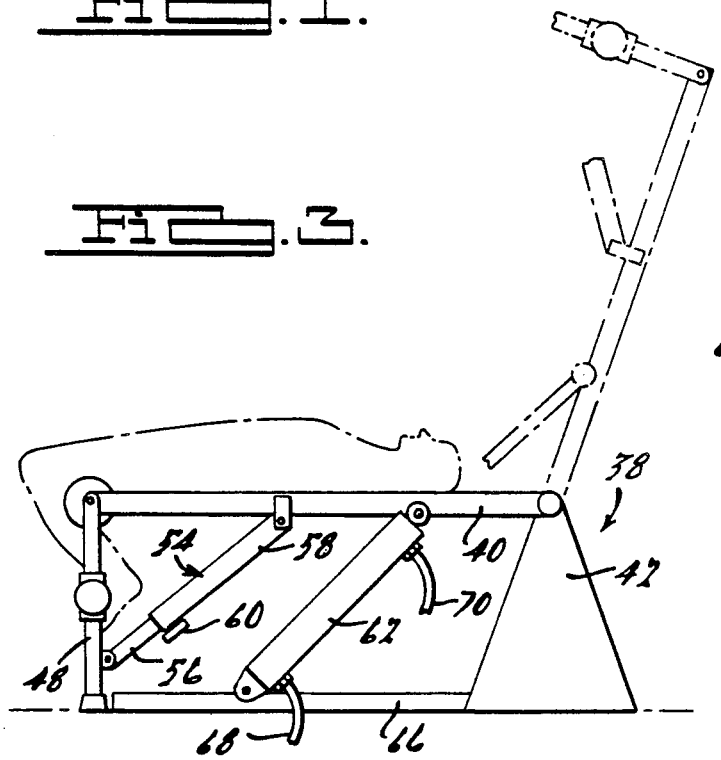
FIG. 3 is a side elevational view of another embodiment of the inversion apparatus in accordance with the present invention.
Figure 4:
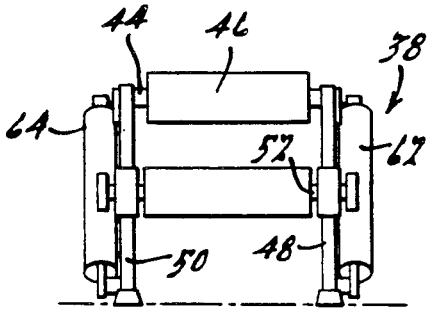
FIG. 4 is a front elevational view of the apparatus illustrated in FIG. 3.
Figure 5:
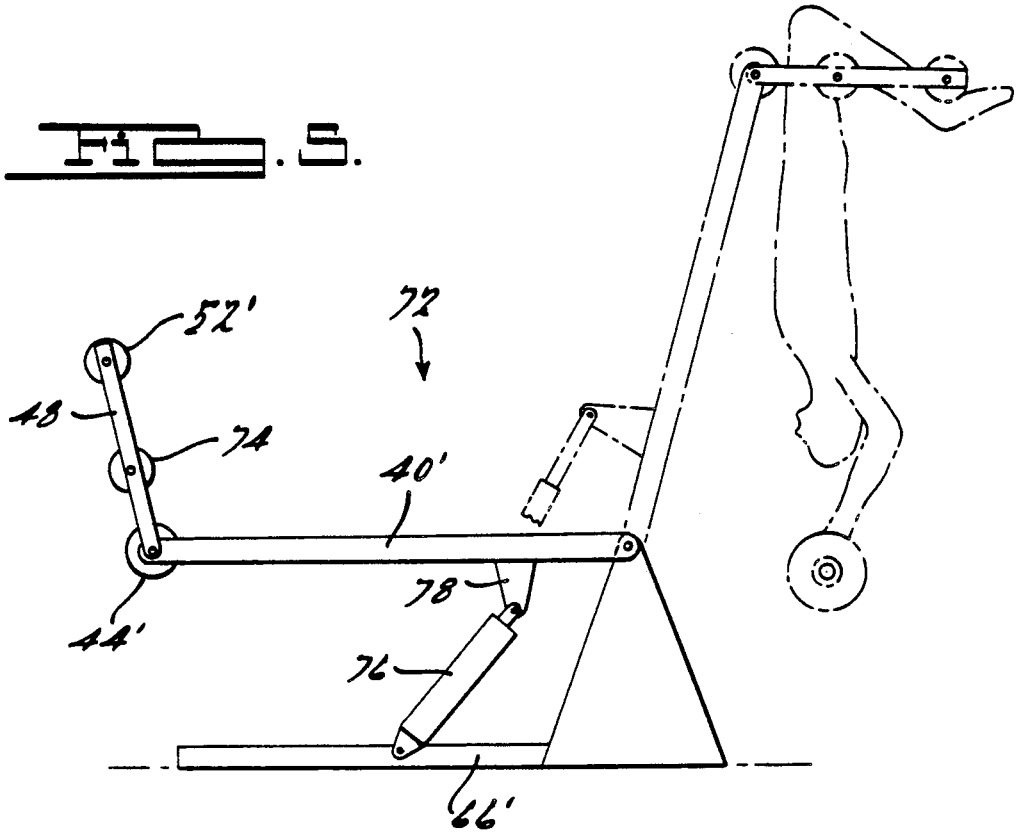
FIG. 5 is a side elevational view similar to that of FIG. 3 but illustrating a modified embodiment of the inversion apparatus illustrated therein, all in accordance with the present invention.

Referring now to FIG. 5, there is illustrated a modification of the embodiment illustrated and described with reference to FIGS. 3 and 4 which is designed to enable an individual to initially recline in a face down position. As shown therein, inversion apparatus 72 is substantially identical to inversion apparatus 38 except as noted below and hence corresponding portions thereof are illustrated by like numbers primed. In this embodiment, leg members 48' and 50' may be pivoted into a generally upwardly projecting position with respect to platform 40' and suitably locked in any desired angular position. Also, in order to enable an individual to initially position himself in a face down position, it is necessary to fit an additional knee support member 74 to legs 48', 50' between instep support member 52' and knee support member 44'. Additionally, in order to elevate platform 40', inversion apparatus 72 employs a single pressure actuated cylinder 76 positioned below platform 40' and extending between base 66' and a depending bracket member 78 secured to the undersurface of platform 40'. Usage of inversion apparatus 72 is substantially the same as described above with respect to apparatus 38 with the exception that the individual initially positions himself in a face down reclining position. Obviously, both instep support 52' and knee support member 74 may be adjustably secured to respective leg members 48', 50' so as to accommodate uses having legs of differing length.

While the embodiments of FIGS. 3 through 5 have all been described with reference to the use of a pneumatic or hydraulically actuated piston in order to move the platform thereof into a vertically oriented position, other drive arrangements may be easily substituted therefor. As best seen with reference to FIGS. 6 and 7, it may be desirable in certain applications to provide the platform 40" with a pair of converging angularly extending support members 80, 82 extending generally outwardly and downwardly from the pivotably supported end portion thereof. A suitably threaded rod member 84 may then be utilized with one end 86 attached to the outer end of this extension and cooperating with a suitable electric motor brake drive assembly 88 positioned below platform 40". In this arrangement, the motor brake drive assembly 88 may operate to rotatably drive a threaded member so as to draw the threaded rod member to the left as illustrated therein via suitable gear reducing means so as to thus move the platform into or out of the generally vertical position. Preferably the electric motor brake drive assembly 88 will be fitted with a suitable brake mechanism whereby upon de-energization of the motor, the brake will automatically engage and operate to prevent further movement of the drive assembly thereby maintaining the platform in any desired elevated position. Alternatively, however, it may be possible, assuming a sufficient degree of gear reduction that the brake mechanism may be omitted therefrom or substantially reduced in size or capacity.

Another drive arrangement is illustrated and will be described with reference to FIGS. 8 and 9. In this embodiment, indicated generally by reference number 222, platform 224 is pivotably supported entirely and in cantilevered relationship to base 226 by use of either a single or multiple spaced coaxial pivot points. Base 226 will also preferably serve to house a suitable drive arrangement whereby platform 224 may be elevated about the single or multiple pivot points from an initial horizontal position to any desired degree of elevation. Any suitable drive arrangement may be employed therein such as for example an electric motor and/or brake assembly operating through suitable gear reduction means driving a gear segment secured to the pivotably supported end of the platform 224. Alternatively, chain or belt drives could be employed. In any event this embodiment offers the advantage of being extremely compact and occupies only a very limited area. It should be noted that this drive arrangement is well suited for use in place of the drive arrangements illustrated in connection with any of the other embodiments disclosed herein.

Figure 6:
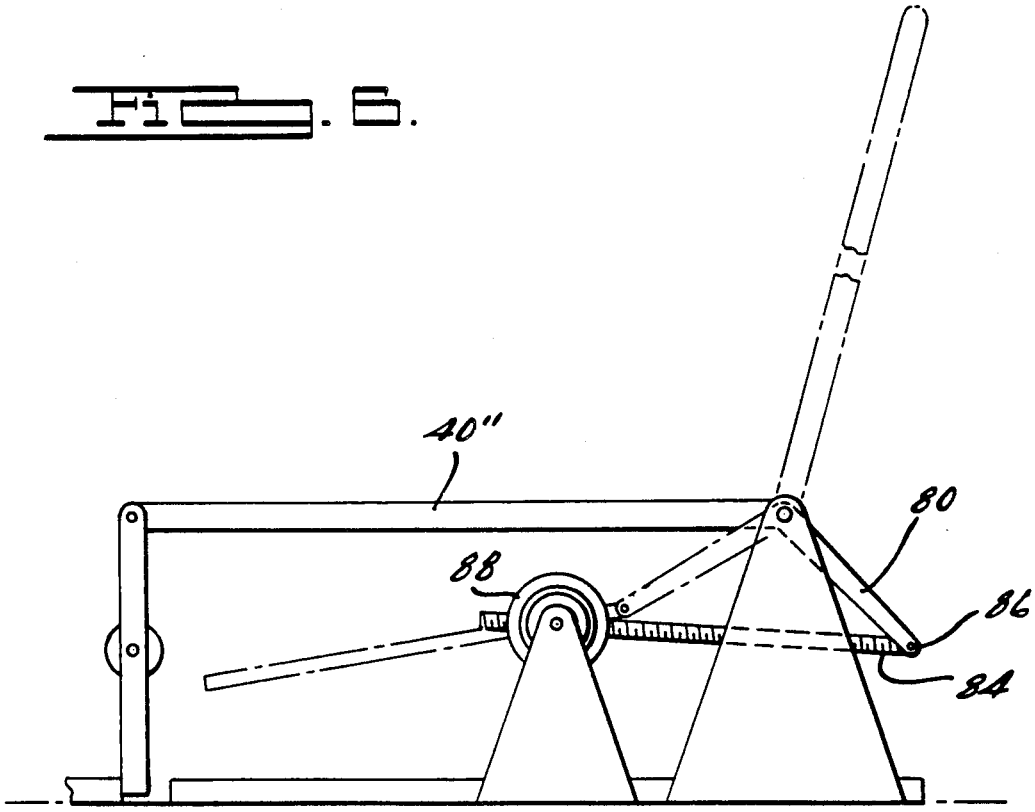
FIG. 6 is a view similar to that of FIG. 3 but illustrating an alternative drive arrangement therefor.

Alternatively, as shown in FIG. 10 in lieu of the screw drive arrangement illustrated and described with reference to FIGS. 6 and 7, it may also be possible or desirable to employ a hydraulic or pneumatically actuated cylinder 90 operable between a fixed pivot point 92 and support members 80', 82' provided on the platform. Again, this drive arrangement may also be used with any of the embodiments illustrated if desired.

Figure 13:
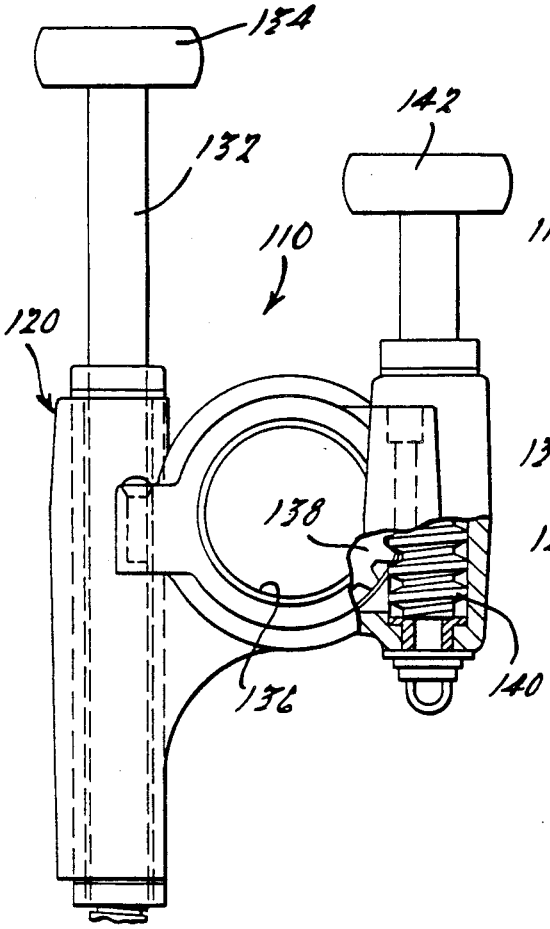
FIG. 13 is an enlarged fragmentary view of the angulation adjustment forming a part of the inversion apparatus illustrated in FIGS. 10 and 11.
Figure 12:
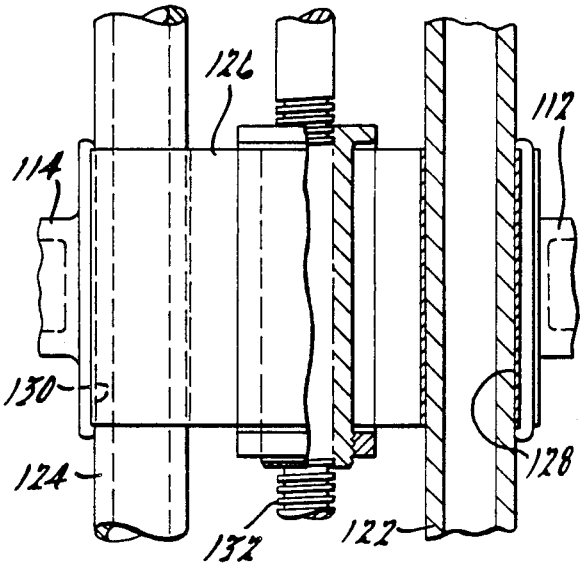
FIG. 12 is an enlarged fragmentary detail view of the instep adjustment arrangement illustrated in FIG. 11.

Inversion apparatus 94 illustrated in FIG. 10 also incorporates an alternative arrangement for both adjusting the relative distance between the knee and instep support members 96 and 98 as well as the relative angulation between platform 100 and the instep support member 98 as is best seen and will be described with reference to FIGS. 11 through 13.

Referring now to FIG. 11, a knee support member 96 is provided positioned between and supported at one end of platform 100 and outwardly from a pair of vertically extending leg members 102, 104. The knee support member 96 includes a pair of laterally spaced pad members 106, 108 and an instep support end adjustment assembly 110 positioned therebetween. Instep support 98 is positioned below knee support 96 in depending relationship from adjustment assembly 110 and includes a pair of outwardly oppositely projecting rod members 112, 114 to which are fitted suitable pads 116, 118 which are to be engaged by the insteps of a user of apparatus 94.

In order to support instep support 98, adjustment assembly 110 includes a housing 120 from which a pair of elongated guide rod members 122, 124 project in generally spaced parallel relationship. A guide member 126 extends between and is integrally formed with rod members 122, 124 and includes suitably bushinged bores 128, 130 through which guide rods 122, 124 slidably extend.

A threaded shaft 132 also is rotatably supported in an axially fixed position by housing 120 and extends between guide rods 122, 124 in generally parallel spaced relationship thereto and extends through an elongated internally threaded member fixedly secured to guide member 126. The upper end of shaft 132 extends above housing 120 and has a suitable hand wheel 134 secured thereto whereby shaft 132 may be easily manually rotated so as to thereby effect movement of guide member 126 along guide rods 122, 124 so as to thus position instep support 98.

In order to angularly position instep support 98 with respect to knee support 96, support rods 136 of knee support 96 has secured thereto a ring worm 138 disposed within housing 120. A worm 140 is also provided being rotatably supported in engaging relationship with worm gear 138 by housing 120. In order to facilitate rotation of worm 140, a suitable hand wheel 142 is secured to an outwardly projecting end portion thereof. Thus, as worm 140 is rotated, housing 120 and associated guide rods 122, 124 and threaded shaft 132 which support instep support 98 will be moved circumferentially about support rod 136 thereby altering the relative angular relationship between instep support 98 and knee support 96. It should be noted that if desired suitable relatively small electric motors may be employed to rotatably drive either or both shaft 132 and/or worm 140. As is readily apparent, either or both of the instep support distance and angulation adjustments may be incorporated in any of the embodiments disclosed herein.

Figure 14:
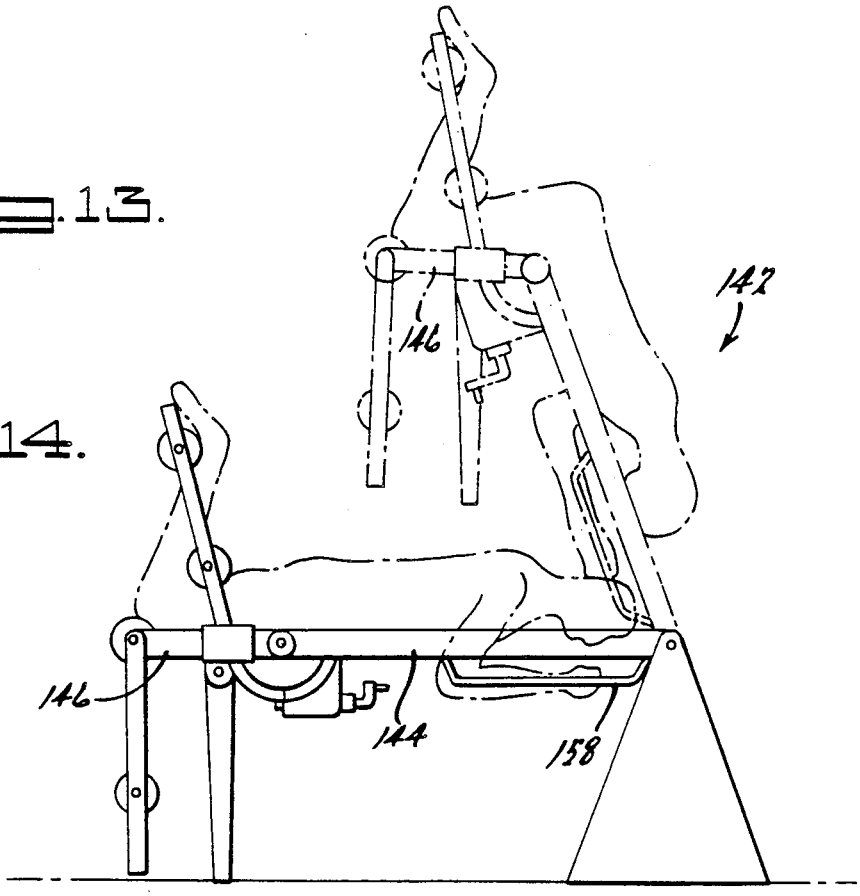
FIG. 14 is a side elevational view of apparatus similar to that illustrated in FIG. 10 but incorporating a further modification to facilitate use by a person desiring to lie in a face down position and requiring additional support along the thigh portion of the leg.
Figure 15:
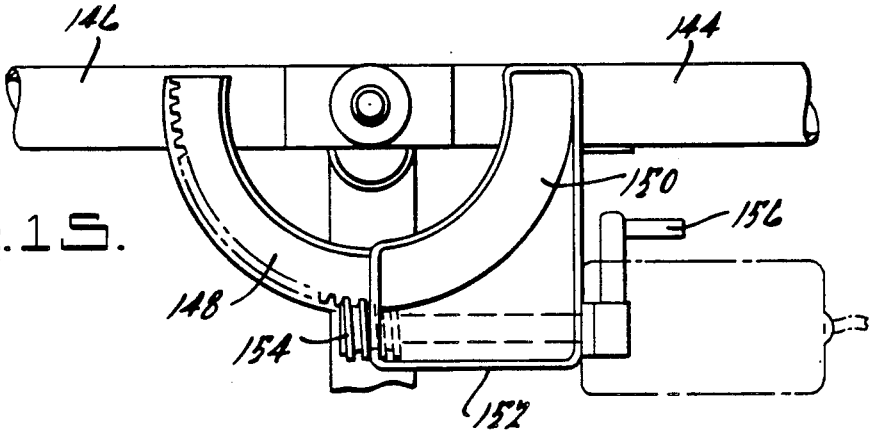
FIG. 15 is an enlarged fragmentary view of the thigh support positioning means incorporated in the embodiment of FIG. 14.

Referring now to FIGS. 14 and 15, there is shown a further modification, generally designated 142, of the inversion apparatus illustrated in FIG. 10 which is particularly designed to enable an individual to be raised into a generally inverted position while being supported both by the knee and instep members as well as by a portion of the platform engaging the thigh portion of the legs. In this embodiment the main platform 144 is provided with a pivotable section 146 at one end thereof which is designed to be moved into a generally horizontal position as shown in phantom when the remaining portion of the platform 144 has been elevated to a generally vertical position. In order to effect the adjustment of this portion of the platform, a suitable arcuate worm gear segment 148 is secured to the platform section 146 and suitable arcuate guide means 150 are provided being secured to platform section 144. A housing 152 containing a worm 154 having a crank handle 156 provided thereon is also provided whereby upon rotation of worm 154 the angulation of the pivoting section 146 of the platform 144 may be easily altered. It is anticipated that a user of this apparatus may require assistance in setup and use thereof. Alternatively, it should also be noted that if desired, the worm 154 may also be driven by a suitable small electric motor operated by switches conveniently located and accessible to the individual lying in a face down position on the platform thereby enabling him to initially raise the platform 144 a few degrees after which the pivoting section 146 of the platform 144 can be lowered to a desired angulation and thereafter the platform 144 raised to its full generally vertical position or to any desired position therebetween.

It should also be noted that inversion apparatus 142 has provided thereon suitable elongated hand grips 158 extending along on opposite sides of and below platform 144 which may provide the user thereof with a greater feeling of security should this be found desirable. Also, again it is readily apparent that features of this embodiment may readily be incorporated into other embodiments disclosed herein should this be desirable.

Figure 17:
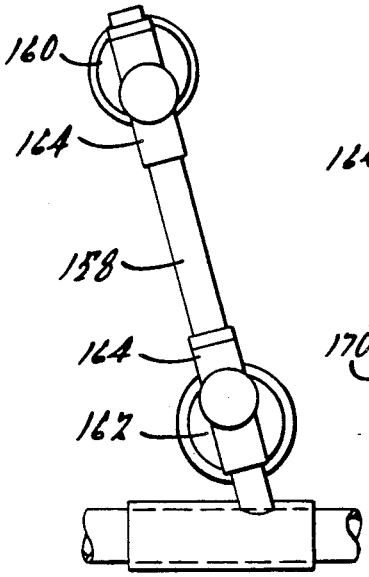
FIGS. 16 and 17 illustrate adjustable means for positioning of the knee and instep support members provided on the embodiment illustrated in FIG. 14.
Figure 16:
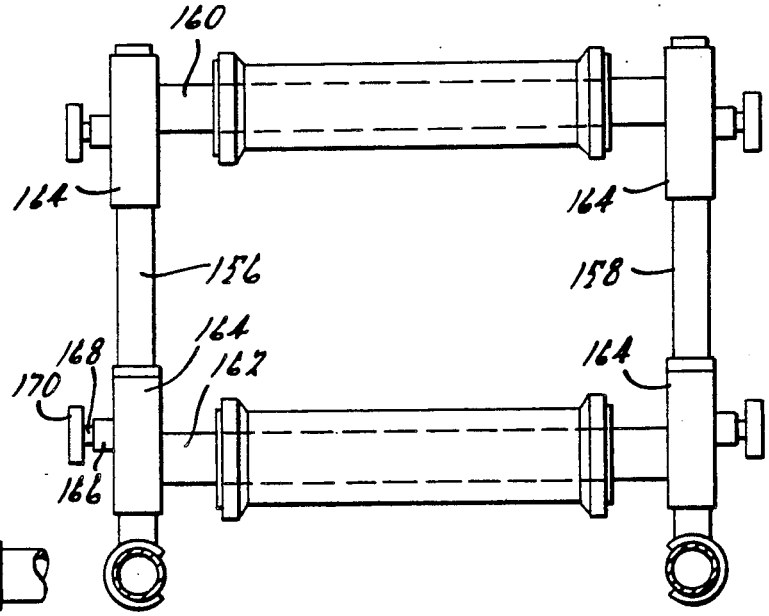

Referring now to FIGS. 16 and 17, there is shown one form by which the adjustable knee and instep support members provided on the various embodiments may be adjustably fitted to the frame members. As illustrated therein, a pair of upstanding frame members 156, 158 are positioned in generally parallel relationship to each other having both instep and knee support members 160, 162 extending therebetween. The knee and instep support members 160, 162 each have a generally cylindrically shaped hollow tube member 164 secured to opposite ends thereof which is designed to slide up and down the respective frame members 156, 158. In order to secure the hollow tube members 164 in any desired location, a generally cylindrically shaped projection 166 is provided having an internally threaded bore provided therein through which a suitable set screw 168 is designed to move into clamping engagement with the sidewall of the respective frame members 156, 158. In order to facilitate rotational movement of the set screws 168, suitable hand wheels 170 are provided on the outer ends thereof. Thus, in order to adjust the relative positioning of either the knee or instep support members, the individual need merely loosen each of the set screw members on opposite ends of the support member, slide the support member to the desired position and thereafter retighten the set screws. It should also be noted that while as illustrated in FIGS. 16 and 17, frame members 156, 158 are rigid and hence do not allow for relative angular adjustment of the instep support member 160 relative to knee support member 162, it may be desirable to provide such a feature. One way of accomplishing this objective would be to support instep support member 160 on a pair of separate spaced parallel frame members having their lower ends pivotably secured to respective tube members 164 with tube members 164 being slidably and adjustably supported on frame members 156, 158. This would thus preserve the adjustability of knee support member 162 as well as provide for the desired angular adjustment of instep support member 160.

Figure 18:
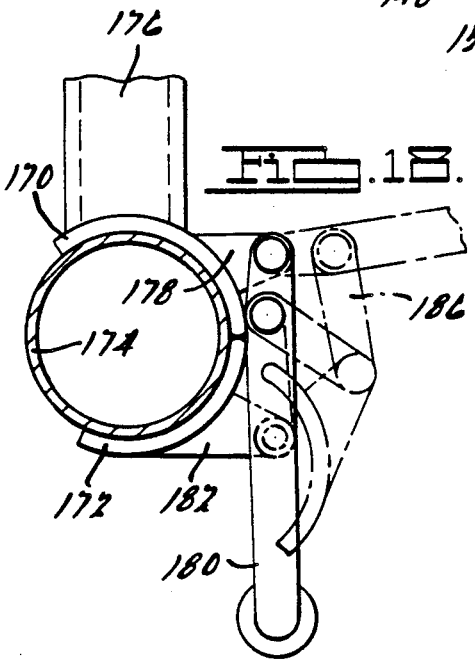
FIGS. 18 and 19 illustrates an alternate releasable clamping arrangement for adjusting and securing various of the support members in a desired position with respect to the main frame members of the inversion apparatus illustrated and disclosed herein, all in accordance with the present invention.
Figure 19:
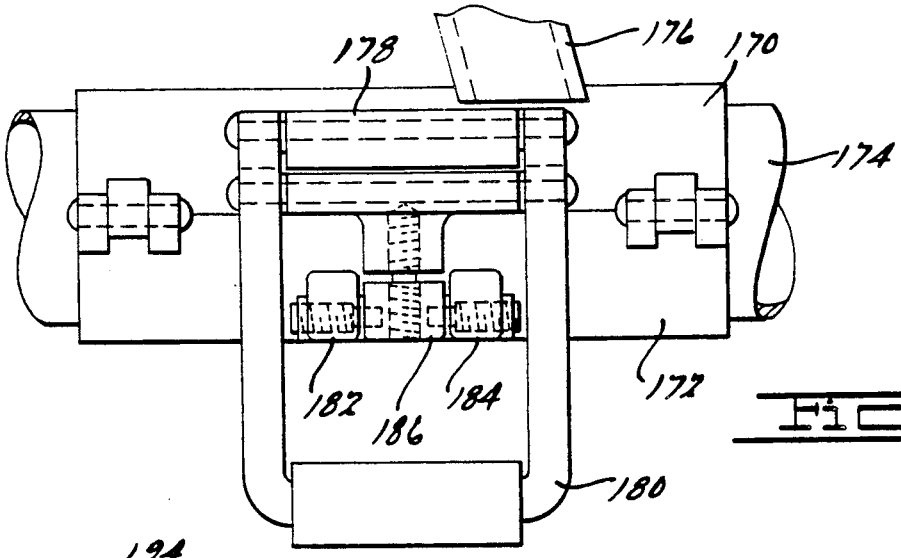

An alternative means for securing either of the knee or instep support members in a desired position along the upstanding frame members is illustrated and will be described with reference to FIGS. 18 and 19. As shown therein, the clamping arrangement comprises first and second arcuate cylindrical segments 170, 172 which are designed to surround a substantial portion of the cylindrical sidewalls of an associated frame member 174. One of these segments is secured to the terminal end portion of the knee or instep support member 176 and also has a generally radially outwardly extending flange portion 178 provided thereon to which is pivotably secured an actuating handle 180. Similarly, the other arcuate segment 172 also has a pair of spaced generally radially outwardly extending flange portions 182, 184 having a connecting link 186 pivotably secured therebetween. The opposite end of the connecting link 186 is secured to the actuating handle 180 adjacent to but spaced from the pivotable connection of the actuating handle 180 to the first flange portion 178. In this manner, a quick and easy release of the clamping mechanism may be provided by merely swinging the actuating handle 180 so as to thereby move the connecting link 186 into the position illustrated in phantom in FIG. 18 which operates to pull the arcuate clamping segment 172 out of engagement with the frame member thereby releasing the knee or instep support member for repositioning and/or removal. Once the knee or instep support member has been positioned in a desired location, the operator need merely move the actuating handle 180 in a circumferential direction so as to thereby move the arcuate flange member 172 into clamping engagement with the frame member 174 thus securing the knee or instep support in a desired location. As noted in FIG. 18, the locking position illustrated in full lines therein provides an overcenter type latching mechanism wherein the connecting link 186 bears against the arcuate flange member 170. This arrangement is particularly advantageous in that it allows for quick and easy adjustment as well as removal of the associated apparatus.

Figure 21:
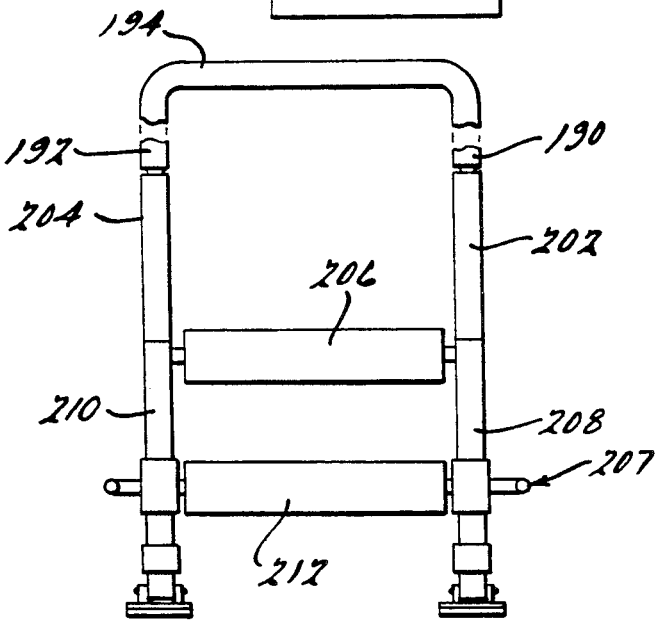
FIG. 21 is a back elevational view of the embodiment illustrated in FIG. 20.
Figure 20:
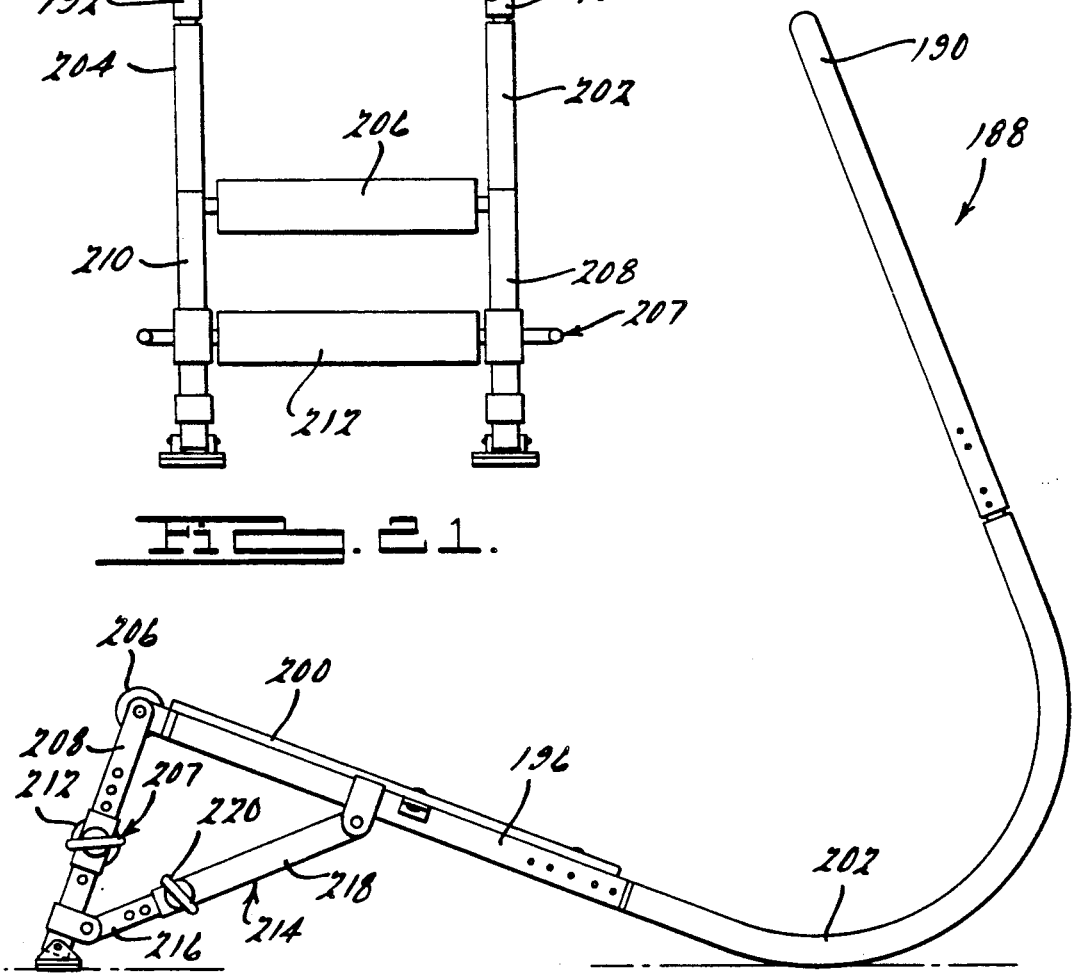
FIG. 20 illustrates yet another embodiment of the inversion apparatus in accordance with the present invention which is particularly well suited for use by children.

While the above described embodiments are well suited for use by individuals of a wide variety of sizes and agility, there may very well be situations where a younger individual may wish to avail themselves of the therapeutic attributes of the inversion apparatus of the present invention. Accordingly, there is illustrated in FIGS. 20 and 21 an embodiment of the present invention generally designated by number 188 which is particularly well suited for younger individuals such as for example children. As illustrated therein, the inversion apparatus 188 comprises a frame assembly comprising three sections all of which are interconnected to form a generally U or V-shaped apparatus as viewed from the side thereof. The frame assembly comprises an upper section consisting of two relatively straight elongated leg sections 190, 192 positioned in generally parallel spaced relationship and an interconnecting integrally formed portion 194 at the upper end thereof. The opposite end of the frame assembly comprises a pair of generally straight elongated members 196, 198 having a platform 200 extending therebetween, the platform 200 extending substantially over the entire length thereof. Respective ends of these relatively straight sections 190, 192, 196, 198 are connected to respective of a pair of arcuately shaped intermediate sections 202, 204. Extending between the frame members 196, 198 at one end of the platform is a knee support bar member 206 having a suitable pad fitted thereto. Also secured to opposite ends of the knee support bar are a pair of leg members 208, 210 extending generally downwardly therefrom which are designed to support the apparatus with the platform in a slightly elevated inclined position generally as shown. An instep support bar 212 also having a suitable pad member secured thereto is adjustably fitted between the leg members and may be moved to varying positions with respect to the knee support member 206 and locked in position via locking means 207 so as to accommodate different length lower leg sections of the users thereof. This version of the apparatus also incorporates means whereby the relative angulation of the instep support member 212 with respect to the knee support member 206 may be suitably adjusted. In order to accomplish this, brace members 214 are provided each having one end pivotably secured to the lower end of each of the leg members 208, 210 and an opposite end secured to the relatively straight frame section 196, 198. The brace members 214 comprises two sections 216, 218 which are designed to be telescopically interfitted with each other and includes locking means 220 for clamping the telescoping members in any desired position with respect to each other. Thus, as is readily apparent, the relative angulation of the instep support member 212 with respect to the knee support member 206 may be easily altered by merely telescoping the brace members inwardly or outwardly so as to change the overall length thereof and thus reposition legs 208, 210.

Figure 22:
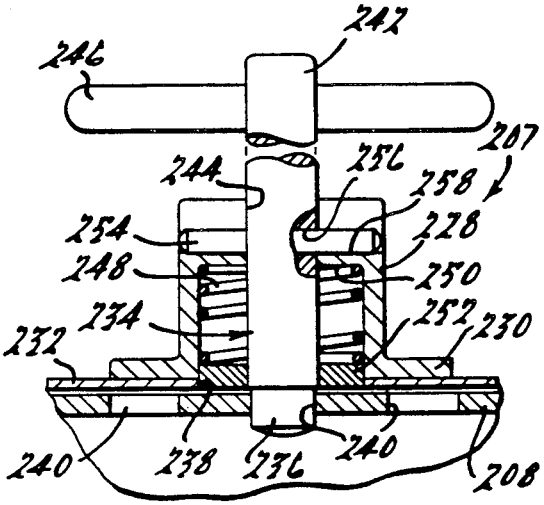
FIG. 22 is an enlarged fragmentary section view of an alternative quick release locking assembly for use in adjustably positioning various support members.

Locking means 220 are substantially identical in construction and operation to locking means 207 which, as best seen with reference to FIG. 22, comprises a generally inverted cup-shaped member 228 having a generally radially outwardly projecting annular flange portion 230 provided thereon so as to enable it to be welded or otherwise secured to hollow cylindrical member 232 which is slidably supported on leg member 208. A plunger member 234 is movably positioned within cup-shaped member having a first end 236 adapted to project axially outwardly therefrom and through an opening 238 in hollow cylinder and be received within a respective one of a plurality of longitudinally aligned spaced openings 240 provided on leg member 208. The opposite end 242 of plunger member projects outwardly through a central bore 244 provided in cup-shaped member 228 and has a diametrically extending handle member 246 secured thereto.

In order to bias plunger member 234 into a locking position such as that shown in FIG. 22, a helical coil spring 248 is provided which acts between inner surface 250 of cup-shaped member 228 and a suitable annular flange member or washer 252 suitably secured to plunger member 234 adjacent end 236.

In order to maintain locking means 207 in a released position so as to facilitate positioning of instep support bar 212, a roll pin 254 is provided secured within a diametrically extending bore 256 provided in plunger member 234 intermediate its ends. Also a diametric slot 258 is provided in the outer surface of cup-shaped member. Thus, in order to reposition instep support bar 212, it is first necessary to grasp handle 246 and pull plunger 228 outwardly out of engagement with openings 240 while simultaneously moving pin 254 out of slot 258. By turning handle member 246 slightly, pin 254 will move out of alignment with slot 258 and bear against the outer surface of cup-shaped member 228 thus maintaining the locking means in a released position. Once instep support bar 212 has been moved to its desired position, handle member 246 may be easily rotated slightly so as to move pin 254 into alignment with slot 258 whereupon spring 248 will operate to move plunger 234 into engagement with a suitably positioned opening 240 in leg member 208 and thereafter maintain locking means 207 in a locked position.

As may now be appreciated, the above described locking means 207 provides a very quick and easy means whereby the instep support bar may be very easily and conveniently repositioned yet also assure a positive secure locking arrangement which effectively and reliably locks the associated support member in the desired position. It should be noted that while locking means 207 has been described for use in conjunction with child's inversion apparatus 188 it is also well suited for use with any of the other embodiments of the present invention. Similarly, the set screw securing arrangement or clamping arrangement illustrated and described above with respect to FIGS. 16 and 17 or 18 and 19 respectively may be used in lieu of locking means 207 in any of the embodiments although locking means 207 represents the presently preferred arrangement.

In order to utilize the child version 188 of the inversion apparatus of the present invention, the individual need merely position himself in a reclining position on the platform 200 and place his legs over the knee supporting section 206 and into position with respect to the instep support member 212. Thereafter, a supervising individual may easily grasp the interconnecting upper bar portion 194 and pull backward thereby rocking the apparatus along the arcuate sections 202, 204 and moving the individual on the platform into an elevated inverted suspended position. A cross bar may be provided if desired extending between arcuate sections 202, 204 at a position to provide a suitable foot rest to aid in moving platform 200 into an elevated position.

Referring now to FIGS. 23 through 28, there is shown a modified embodiment 260 of the present invention somewhat similar to inversion apparatus 188 above. Inversion apparatus 260 includes a generally J-shaped frame assembly 262 similar to that of the frame assembly described above and comprises a pair of elongated tubular members 264, 266 positioned in generally spaced parallel relationship. A handle portion 268 including a lifting bar 270 extends between and interconnects the upper ends of members 264, 266 and a second interconnecting cross bar 272 extends therebetween spaced below handle 268 and serves to further rigidify the assembly. Preferably, a slight bend (to the right as shown) is provided in each of the tubular members 264, 266 intermediate the length thereof whereby, should a user be grasping the cross bar 272 as the apparatus is raised, his fingers will not become pinched against the floor. A foot bar 274 is also provided extending between elongated tubular members 264, 266 and serves to provide a leverage point to further aid in moving apparatus 260 into an inverted position.

Figure 23:
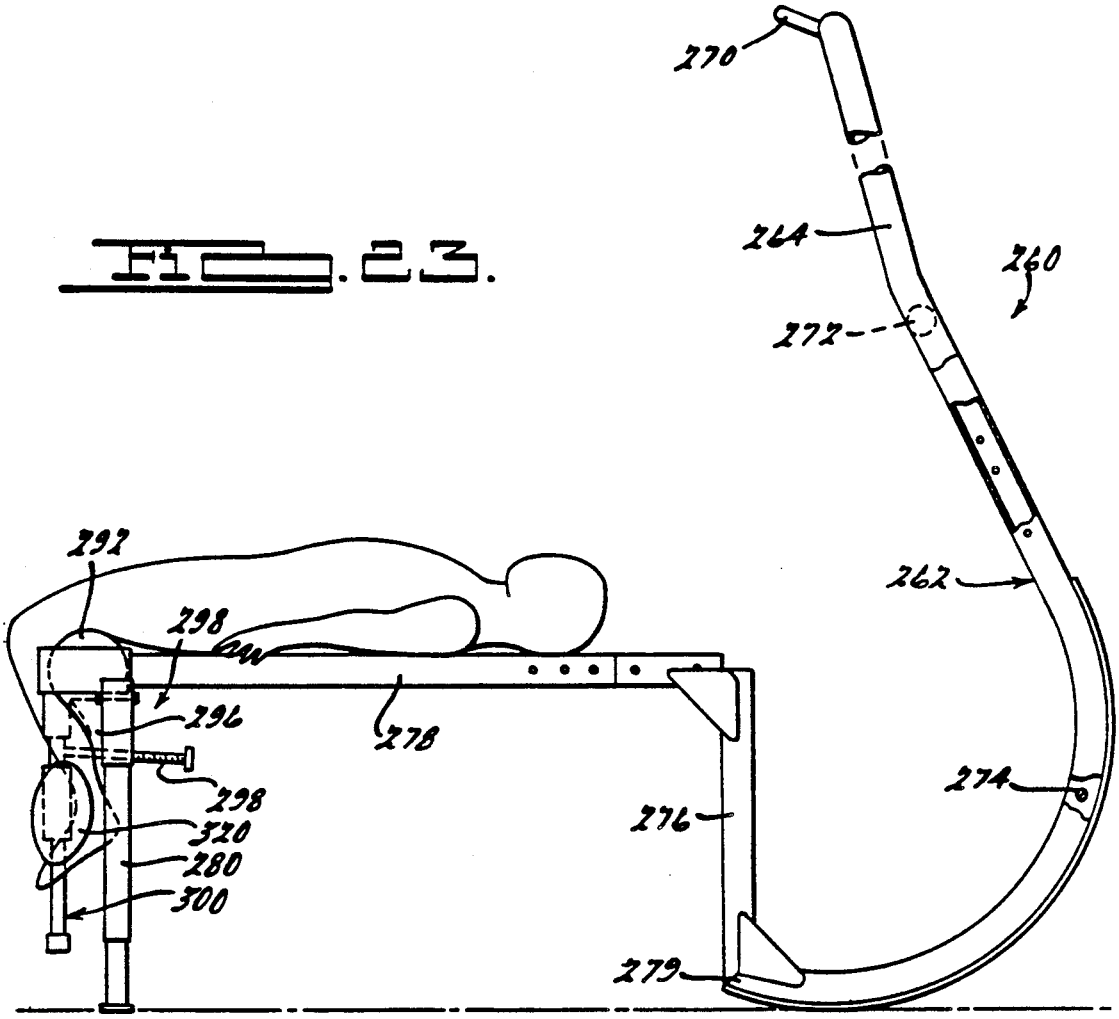
FIG. 23 shows a modified form of the embodiment of FIG. 20 in accordance with the present invention which while being particularly suitable for use by children, may also be used by adults.
Figure 24:
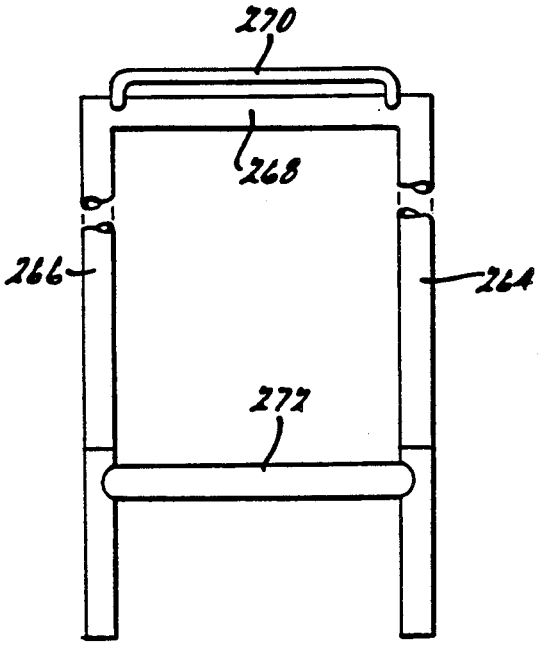
FIG. 24 is a fragmentary detail view of the handle portion of the embodiment shown in FIG. 23.

A pair of generally substantially identical spaced parallel leg members 276 are secured to and extend vertically upward from the respective lower terminal end portions 278 of tubular members 264, 266 and have one end of a platform 278 supportingly secured thereto. A pair of floor engaging supporting legs 280 are secured to opposite sides of platform 278 adjacent the opposite end thereof and serve to support the platform in a lowered generally horizontal position generally as shown in FIG. 23.

Figure 25:
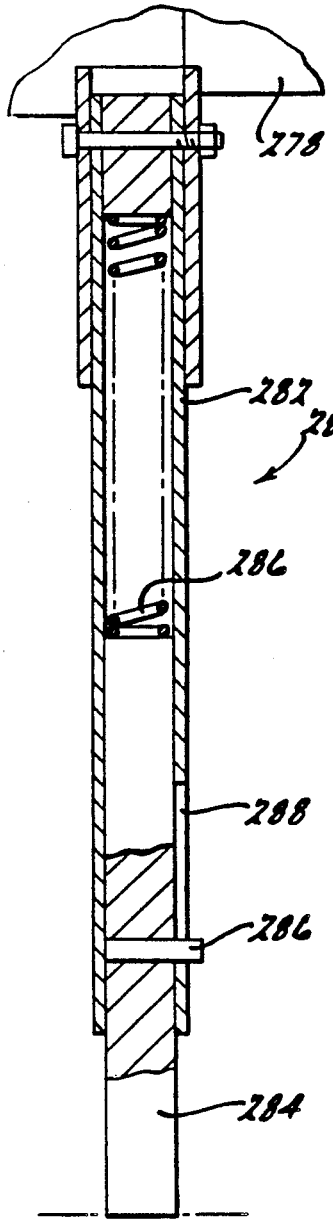
FIG. 25 is an enlarged fragmentary detail view of the leg assembly incorporated in the embodiment of FIG. 20, portions thereof being shown in section.

Preferably as best seen with reference to FIG. 25, legs 280 will each be substantially identical and include an upper hollow tubular member 282 fixedly secured to platform 278 and which is adapted to telescopically slidably receive a lower tubular member 284. A helical coil spring 286 is provided within member 282 and operates to resiliently urge lower member 284 outwardly with respect to member 282. Suitable movement limiting means such as pin member 286 may be provided secured to member 284 and movably received within an axially elongated slot 288. Preferably, the length and location of slot 288 will be such as to stop inward movement of member 284 before spring 286 is fully compressed so as to prevent possible damage thereto. If desired, a suitable cushioning pad may also be provided on the lower floor engaging end of member 284. Thus, leg assemblies 280 will operate to cushion the movement of inversion apparatus 260 as the user is being lowered from a raised position to the generally horizontal position as shown in FIG. 23. It should be noted that if desired, this cushioning leg assembly may be easily incorporated in any of the embodiments described above.

Inversion apparatus 260 also incorporates a pair of spaced modified contoured cushioning pads 292, 294 designed to engage the back of the knee which pads are supported by means of a suitable transversely extending bar at one end of platform 278. Pads 292, 294 are substantially mirror images of each other and each include a depending calf engaging portion 296. Preferably pads 292 and 294 will be pivotably supported on the transversely extending bar 297 and an adjustment assembly 298 will be provided to angularly position the depending calf engaging portions at the desired location. As shown with reference to FIG. 26, adjustment assembly 298 comprises a cross bar 290 extending between and secured to the respective rear surfaces of calf engaging portions 296 of pads 292, 294. A threaded rod member 298 extends through a threaded opening in cross bar 290 intermediate the ends thereof and has a spherical end 299 rotatably supported with a suitable socket assembly 301 secured to a portion of instep support assembly 300. Preferably, the opposite end portions of cross bar 290 will extend between and be suitably secured to the lower calf engaging portions 296 of respective pads 292, 294 by means of suitable brackets 303, 305 which are secured to respective stiffening backing plates 307, 309. Thus, as rod 298 is rotated, the threaded engagement with cross bar 290 will effect movement thereof and hence pivot calf portions 296 of pads 292, 294 to the desired position.

Figure 29:
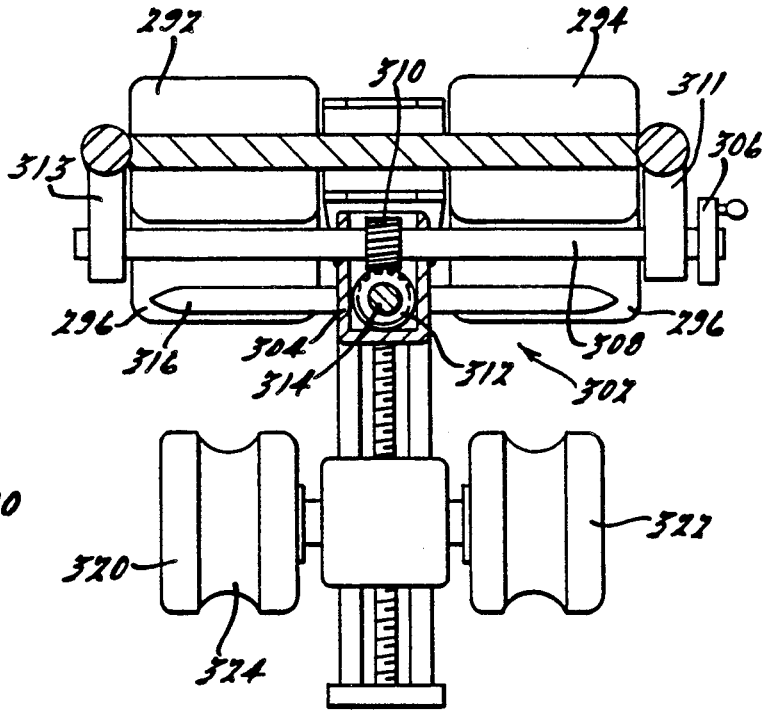
FIG. 29 is an enlarged fragmentary end view of the support pads and adjustment arrangement shown in FIG. 28 as seen looking in the direction of arrow A.
Figure 28:
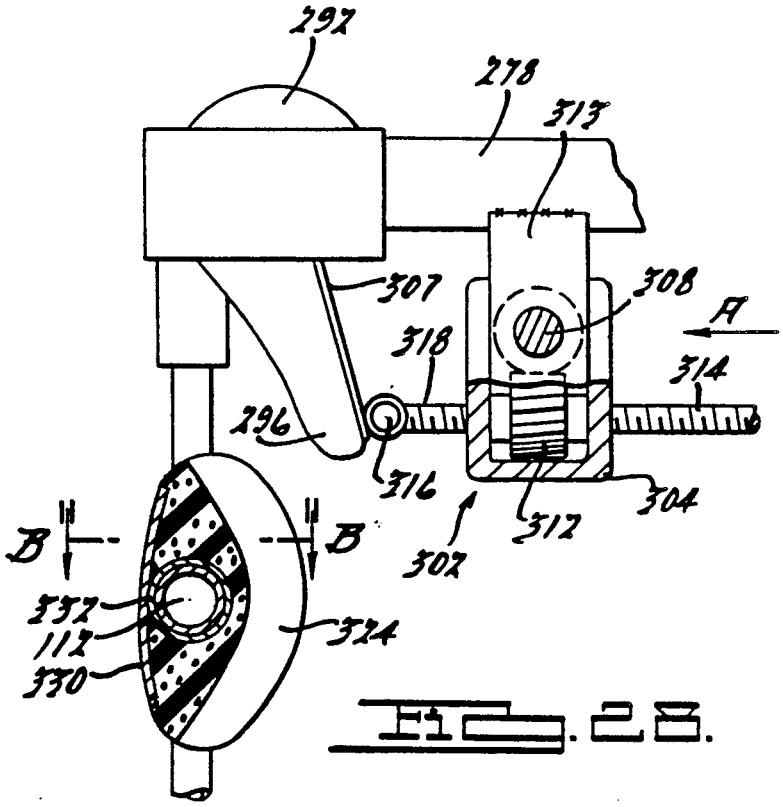
FIG. 28 is a fragmentary view showing a portion of the embodiment illustrated in FIG. 23 but incorporating an alternative calf engaging pad adjustment arrangement.

Referring now to FIGS. 28 and 29, an alternative calf engaging pad adjustment assembly 302 is illustrated and incorporates a central housing 304 pivotably supportingly secured to the underside of platform 278 by means of depending brackets 311, 313 adjacent to but slightly spaced from one end thereof. A drive handle 306 is rotatably supported from platform 278 at a lateral side thereof and includes a rod 308 extending laterally across platform 278 and has secured thereto a helical gear 310 disposed within housing 304. As best seen with reference to FIG. 29, rod 308 extends through suitable openings in both housing 304 and respective brackets 311, 313 so as to thereby serve the dual function of also pivotably supporting housing 304 from these brackets 311, 313. A second helical gear 312 is also supported within housing 304 in meshing engagement with gear 310. An elongated threaded rod member 314 extends through a threaded bore in helical gear 312 and outwardly therefrom. An elongated cross bar 316 has the midpoint thereof fixedly secured to end 318 of rod member 314 and has the opposite ends thereof secured to the calf supporting portions 296 of respective pads 292, 294. Cross bar 316 will therefore operate to prevent relative rotation of rod member 314. Thus as drive handle 306 is rotated, helical gear 310 will drive helical gear 312 which in turn will cause rod member 314 to be driven longitudinally with respect to platform 278 thereby enabling the calf supporting portions 296 of pads 292, 294 to be suitably positioned. Because gears 310, 312 are both disposed within housing 304 which is pivotable with respect to platform 278, the movement of cross bar 316 through the arc of adjustment and hence changing angulation of rod 314 will be easily accommodated by movement of housing 304.

Figure 30:
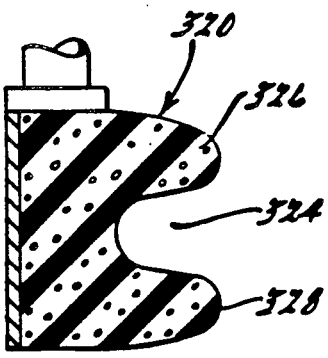
FIG. 30 is a section view of the instep support pad shown in FIG. 29, the section being taken along line B—B thereof.

Inversion apparatus 260 also incorporates an adjustable instep support assembly 300 having a pair of substantially identical cushioned contoured instep supports 320, 322 secured thereto. Preferably the adjustable instep support assembly 300 will be substantially identical in construction and operation to that described with respect to FIGS. 11 through 13 and hence further description thereof is believed unnecessary. However, in this embodiment, pads 116, 118 are replaced with pads 320 and 322 which are substantially identical. As best seen with reference to FIGS. 28 and 30, pad 320 has a recess 324 formed therein defined by a pair of outwardly projecting arms 326, 328 adapted to overlie opposite lateral sides of the instep. Additionally, the recess is arcuately contoured in a generally vertical direction as shown in FIG. 28 so as to generally conform to and engage portions of the leg and foot immediately adjacent the instep. Preferably, pads 320, 324 will each be formed from a suitable resilient cushioning material such as for example a foam rubber and will include a stiffening plate 330 having a cylindrical sleeve 332 secured thereto to facilitate mounting of same on bar 112 as well as imparting greater rigidity thereto. This contoured pad arrangement not only provides an increased surface area for engagement with a user's foot so as to spread the pressure exerted thereon over a greater area but also aids in inhibiting the instep from slipping out of supporting engagement therewith.

Yet another adjustment arrangement for the calf engaging portions 296 of pads 292, 294 is shown in and will be described with reference to FIGS. 31 and 32. In this embodiment, each of the pads 292, 294 has a generally arcuately shaped flange 334, 336 secured to backing plate 307. Flanges 334, 336 are each provided with a series of relatively closely spaced openings 338 arranged in an arc along the length thereof. A second pair of brackets 340, 342 are secured to opposite sides of platform 278 adjacent respective flanges 334, 336. A spring loaded plunger assembly 344, 346 similar to that shown in FIG. 22 is secured to each of brackets 340, 342 and includes inwardly projecting pins 348, 350 adapted to be received with respective ones of openings 338 and to cooperate therewith to lock calf engaging portions 296 in the desired position. In order to insure that the portions 296 are secured in the same position, a relatively rigid plate member 352 extends between and is secured to respective calf engaging portions 296 of pads 292, 294.

In order to aid in the proper positioning of calf engaging portions 296, each of pads 292, 294 may have a suitable biasing spring provided therein such as for example coil springs 354, 356. As shown, springs 354, 356 extend around support bar 358 having one end secured thereto and the other end being secured to backing plate 307 in such a manner as to urge portions 296 outwardly toward and into engagement with the calves of a user of the apparatus.

While the above pads and means for adjusting same have been described with specific reference to their use with inversion apparatus 260, it should be noted that they may easily be incorporated into many of the embodiments described earlier on in this application. Similarly, it should be noted that in addition to the features specifically illustrated in conjunction with inversion apparatus 260, other features described above may be also incorporated therein if desired. For example, the articulated platform arrangement illustrated in FIG. 14 may be incorporated into this embodiment as may the overlying knee and instep support assembly illustrated therein. Further, while the calf engaging adjustment arrangements have been described for manual operation, it would be possible to incorporate relatively small drive motors therein which could be operated from a remote control panel should this be desired.

While it will be apparent that the preferred embodiments of the invention disclosed are well calculated to provide the advantages and features above stated, it will be appreciated that the invention is susceptible to modification, variation and change without departing from the proper scope or fair meaning of the subjoined claims.

I claim:

1. Inversion apparatus for enabling an individual to be supported from the legs in an inverted position, said apparatus comprising:

a frame assembly having opposite ends including an arcuate shaped floor engaging portion intermediate the ends of said frame assembly;

handle means disposed at one end of said frame assembly;

a supporting platform provided on the other end of said frame assembly;

knee support means secured to said frame assembly adjacent one end of said platform and adapted to supportingly engage said individual's legs at the back of the knee;

instep support means pivotably supportingly secured to said frame assembly in generally parallel spaced relationship to said knee support means and adapted to supportingly engage said individual's instep; and adjustment means for positioning said instep support means in any one of a variety of circumferential positions with respect to said knee support means whereby said individual may be supported in an inverted position with the upper and lower leg portions positioned at any desired angulation therebetween;

said handle means being operative upon application of a downwardly directed force thereto to rock said frame assembly over said arcuate shaped floor engaging portion to thereby move said platform to an elevated position; and said knee support means and said instep support means cooperating to support said individual in a generally inverted position when said platform is in said raised position.

2. An inversion apparatus as set forth in claim 1 wherein said supporting platform is positioned in a generally horizontal position when said apparatus is in a lowered position.

3. An inversion apparatus as set forth in claim 1 wherein said supporting platform includes floor engaging leg portions at one end thereof, said leg portions being operative to cushion lowering movement of said inversion apparatus.

4. An inversion apparatus as set forth in claim 3 wherein said leg portions include spring means for cushioning said lowering movement.

5. An inversion apparatus as set forth in claim 4 wherein said leg portions include a first tubular member secured to said platform, a second tubular member telescopically received within said first tubular member and said spring means being disposed within said first tubular member and operative to bias said second tubular member outwardly with respect to said first tubular member.

6. An inversion apparatus as set forth in claim 1 wherein said instep support means may be positioned at a wide variety of distances from said knee support means whereby lower legs of differing length may be accommodated by said apparatus.

7. An inversion apparatus as set forth in claim 6 wherein said frame assembly includes a pair of elongated guide means pivotably secured to one end of said frame assembly in generally parallel spaced relationship, said instep support means extending between and being movable along said guide means.

8. An inversion apparatus as set forth in claim 7 wherein said adjustment means comprise brace members extending between said frame and each of said guide means.

9. An inversion apparatus as set forth in claim 8 wherein said brace members comprise telescopically adjustable first and second members, said telescopically adjustable first and second members cooperating to alter the length of said brace member whereby said instep support means may be positioned at a variety of circumferential positions.

10. An inversion apparatus as set forth in claim 1 wherein said knee support means includes a pair of cushioned members positioned in generally side-by-side spaced relationship, each of said cushioned members including a calf engaging portion.

11. An inversion apparatus as set forth in claim 10 wherein said cushioned members are pivotably supported on said frame assembly.

12. An inversion apparatus as set forth in claim 11 further comprising adjustment means for adjustably effecting pivotal movement of said cushioned members whereby said calf engaging portions may be moved to a desired position.

13. An inversion apparatus as set forth in claim 1 wherein said instep support means comprise a pair of spaced cushioned members, each of said cushioned members including a recess adapted to receive a user's instep and arm portions adapted to overlie opposite lateral side portions of a user's foot to thereby inhibit disengagement between said instep support means and said instep.

14. Inversion apparatus for enabling an individual to be supported from the legs in an inverted position, said apparatus comprising:

a frame assembly having opposite ends including an arcuate shaped floor engaging portion intermediate the ends of said frame assembly;

a supporting platform provided on said frame assembly;

means for effecting movement of said supporting platform from a generally horizontal position to an elevated position;

knee support means secured to said frame assembly adjacent one end of said platform and adapted to supportingly engage said individual's legs at the back of the knee, said knee support means including a pair of spaced cushioned members each having depending calf engaging portions;

instep support means secured to said frame assembly in generally parallel spaced relationship to said knee support means and adapted to supportingly engage said individual's instep; and said knee support means and said instep support means cooperating to support said individual in a generally inverted position when said platform is in said raised position.

15. An inversion apparatus as set forth in claim 14 further comprising adjustment means for positioning said instep support means in any one of a variety of circumferential positions with respect to said knee support means whereby said individual may be supported in an inverted position with the upper and lower leg portions positioned at any desired angulation therebetween.

16. An inversion apparatus as set forth in claim 14 wherein said cushioned members are pivotably supported on said frame assembly.

17. An inversion apparatus as set forth in claim 16 further comprising adjustment means for adjustably effecting pivotal movement of said cushioned members whereby said calf engaging portions may be moved to a desired position.

18. An inversion apparatus as set forth in claim 14 wherein said instep support means comprise a pair of spaced cushioned members, each of said cushioned members including a recess adapted to receive a user's instep and arm portions adapted to overlie opposite lateral side portions of a user's foot to thereby inhibit disengagement between said instep support means and said instep.

19. Inversion apparatus for enabling an individual to be supported from the legs in an inverted position, said apparatus comprising:

a frame assembly having opposite ends including an arcuate shaped floor engaging portion intermediate the ends of said frame assembly;

a supporting platform provided on said frame assembly;

means for effecting movement of one end of said platform from a generally horizontal position to an elevated position;

knee support means secured to said frame assembly adjacent one end of said platform and adapted to supportingly engage said individual's legs at the back of the knee;

instep support means secured to said frame assembly in generally parallel spaced relationship to said knee support means and adapted to supportingly engage said individual's instep;

said knee support means and said instep support means cooperating to support said individual in a generally inverted position when said platform is in said raised position; and ground engaging leg means for supporting said one end of said platform, said leg means including cushioning means for cushioning movement of said one end of said platform from an elevated position to said generally horizontal position wherein said leg means moves into engagement with said ground.

20. An inversion apparatus as set forth in claim 19 wherein said leg means include spring means for cushioning said lowering movement.

21. An inversion apparatus as set forth in claim 20 wherein said leg means include a first tubular member secured to said platform, a second tubular member telescopically received within said first tubular member and said spring means being disposed within said first tubular member and operative to bias said second tubular member outwardly with respect to said first tubular member.

22. An inversion apparatus as set forth in claim 19 wherein said instep support means are pivotably secured to said frame assembly and further including adjustment means for positioning said instep support means in any one of a variety of circumferential positions with respect to said knee support means.

* * * * *

UNITED STATES PATENT AND TRADEMARK OFFICE

CERTIFICATE OF CORRECTION

PATENT NO. : 5,002,043

DATED : March 26, 1991

INVENTOR(S) : Achilles N. George

It is certified that error appears in the above-identified patent and that said Letters Patent is hereby corrected as shown below:

Column 4, line 47, "ascent" should be --ascend--.

Signed and Sealed this

Second Day of March, 1993

*Attest:*

STEPHEN G. KUNIN

*Attesting Officer*

*Acting Commissioner of Patents and Trademarks*